US005366221A

United States Patent [19]

Schwartz et al.

[11] Patent Number: 5,366,221

[45] Date of Patent: Nov. 22, 1994

[54] RANDOM PLAY INDICATOR

[75] Inventors: Stephen Schwartz, 507 Cole Ave., Providence, R.I. 02906; Howard Kamentsky, 215 A St., Boston, Mass. 02210; Michael Gorker, Sharon, Mass.

[73] Assignees: Stephen Schwartz, Providence, R.I.; Howard Kamentsky, Boston, Mass.

[21] Appl. No.: 99,931

[22] Filed: Jul. 29, 1993

[51] Int. Cl.[5] ..... A63F 5/04

[52] U.S. Cl. ..... 273/142 A; 273/139

[58] Field of Search ..... 273/138 R, 142 R, 143 B, 273/142 B, 142 A, 142 H, 138 A, 141 A

[56] References Cited

U.S. PATENT DOCUMENTS

| | | | |
|---|---|---|---|
| D. 130,363 | 11/1941 | Webber . | |
| 355,947 | 1/1887 | Parfitt | 273/142 H |
| 1,393,494 | 10/1921 | Bryant | 273/142 B |
| 1,741,903 | 12/1929 | Amend | 273/142 B |
| 2,152,598 | 3/1989 | Mills | 273/142 B |
| 3,184,872 | 5/1965 | Way | 273/142 A |
| 3,195,896 | 7/1965 | Markham . | |
| 3,198,522 | 8/1965 | Parks . | |
| 3,210,081 | 10/1965 | Rapaport . | |
| 3,654,710 | 4/1972 | Barnard . | |
| 3,834,711 | 9/1974 | Breslow . | |
| 3,841,637 | 10/1974 | Piazza et al. . | |
| 4,171,813 | 10/1979 | Kuna et al. . | |
| 5,188,363 | 2/1993 | Marnell et al. | 273/142 B X |

*Primary Examiner*—William E. Stoll

*Attorney, Agent, or Firm*—Kurt R. Benson

[57] ABSTRACT

A random play indicator includes a base portion having a light station thereon, a light source in the base portion for illuminating the light station, a manually rotatable randomizer wheel including a plurality of different colored light segments, and a diffuser dome. The randomizer wheel is rotatably mounted on the base portion so that sequential different colored segments thereof sequentially pass over-the light station as the randomizer wheel is rotated, and the diffuser dome is mounted on the base portion over the randomizer wheel for diffusing light passing through the segment of the randomizer wheel aligned with the light station at any given time.

9 Claims, 5 Drawing Sheets

RANDOM PLAY INDICATOR

BACKGROUND AND SUMMARY OF THE INVENTION

The instant invention relates to games and more particularly to a random play indicator for randomly indicating a course of game play by randomly selecting and displaying one of several different game colors.

A variety of different types of random play indicators have been heretofore available for use in connection with various games. Further, a number of play indicators have been heretofore available which have been capable of randomly selecting different colors or randomly illuminating various elements as a means for randomly directing game play. In this regard, the U.S. patents to Weber U.S. Pat. No. Des. 130,363, Markham U.S. Pat. No. 3,195,896, Parks U.S. Pat. No. 3,198,522, Rapaport U.S. Pat. No. 3,210,081, Barnard U.S. Pat. No. 3,654,710, Breslow U.S. Pat. No. 3,834,711, Piazza et al U.S. Pat. No. 3,841,637 and Kuna et al U.S. Pat. No. 4,171,813 disclose devices which are generally exemplary of the heretofore available random play indicators which utilize color and/or light for randomly directing game play. However, these references, which represent the closest prior art to the subject invention of which the applicant is aware, fail to provide a random play indicator which is capable of randomly illuminating various different colored sectors of a rotatably mounted randomizer wheel for displaying light of a randomly selected color. They also fail to provide a device of this type which includes a diffuser dome for diffusing colored light from a randomizer wheel so as to provide a dome-shaped element which is illuminated with light of a randomly selected color. Hence, the known prior art devices are believed to be of only general interest with respect to the random play indicator of the instant invention.

The instant invention provides an improved random play indicator which is capable of illuminating a diffuser dome with light of a randomly selected color for randomly directing game play. More specifically, the random play indicator of the instant invention comprises a base having a light station thereon, a randomizer wheel including a plurality of different colored radially extending translucent sectors rotatably mounted on the base and a light source in the base. The randomizer wheel is rotatably mounted so that sequential sectors thereon sequentially pass by the light station, and the light source on the base is operative for selectively illuminating the sector located at the light station at any given time. The randomizer preferably further comprises a translucent diffuser dome over the randomizer wheel for diffusing the light emitted from the sector which is illuminated at any given time. The randomizer preferably further comprises registration means for assuring that only a single sector on the randomizer wheel is located at the light station any time the randomizer wheel is stationary with respect to the light station. The diffuser dome preferably has a multifaceted inner surface for diffusing light from the randomizer wheel so that the entire diffuser dome appears to sparkle with light of the randomly selected color. The diffuser dome preferably has an open area along one side thereof, and a portion of the randomizer wheel extends outwardly through the open area to permit manual rotation of the randomizer wheel with a finger of a user. Further, the light station is preferably located so that it illuminates a portion of the randomizer wheel which is substantially diametrically opposite to the portion of the randomizer wheel which extends outwardly through the open area.

It has been found that the random play indicator of the instant invention can be effectively utilized for randomly selecting a color for the purpose of directing game play. Specifically, it has been found that by providing a randomizer wheel which is rotatably mounted on a base so that various different colored sectors on the wheel pass over and are illuminated at a light station, the device is easily manipulated by manually rotating the randomizer wheel during the course of game play. Further, by providing a multifaceted diffuser dome over the randomizer wheel for diffusing light from the illuminated sector, the play indicator of the instant invention provides a more intriguing type of device, wherein the entire diffuser dome is illuminated with light of a randomly selected color rather than a localized area thereon. Further, by providing a registration mechanism for registering the randomizer wheel so that only a single sector is illuminated whenever the wheel is stopped, the diffuser dome is more effectively illuminated with only the appropriate randomly selected color.

Accordingly, it is a primary object of the instant invention to provide an effective random play indicator which is operative for illuminating a diffuser dome with light of a randomly selected color.

Another object of the instant invention is to provide a random play indicator comprising a rotatable randomizer wheel having a plurality of different colored translucent sectors thereon which are randomly illuminated for indicating a course of game play.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
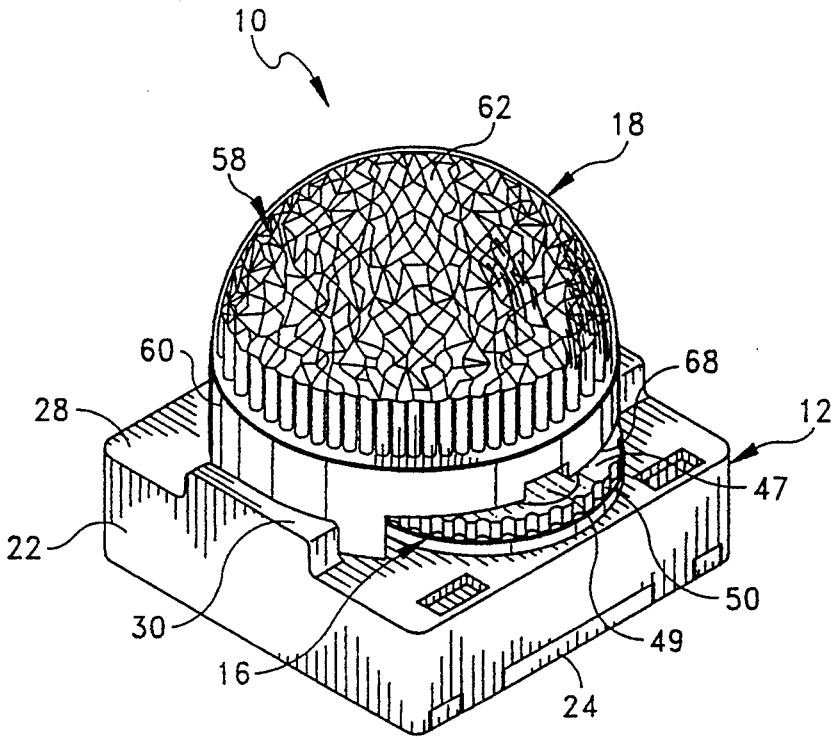
FIG. 1 is a front perspective view of the random play indicator of the instant invention.
Figure 2:
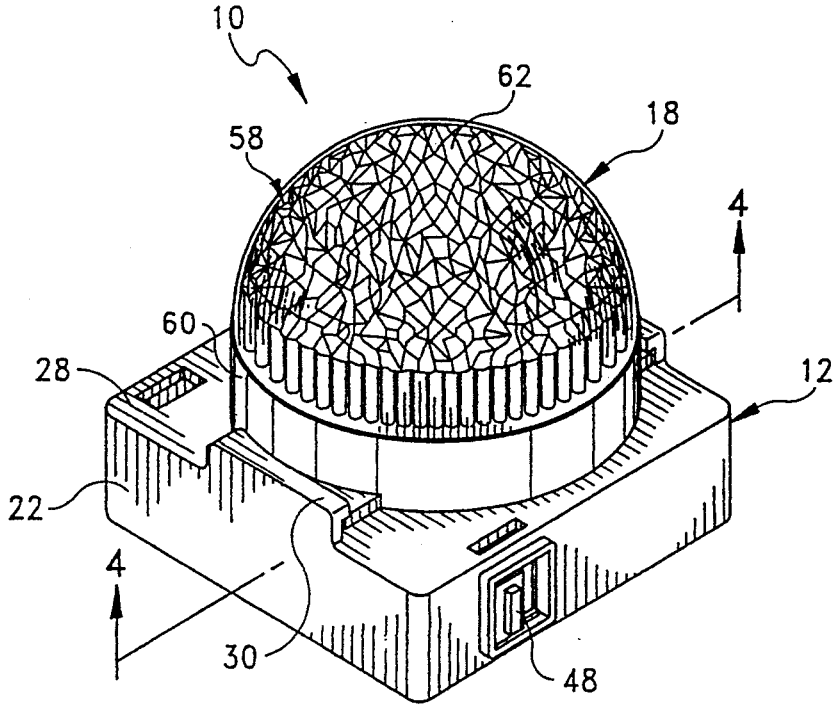
FIG. 2 is a rear perspective view thereof.
Figure 3:
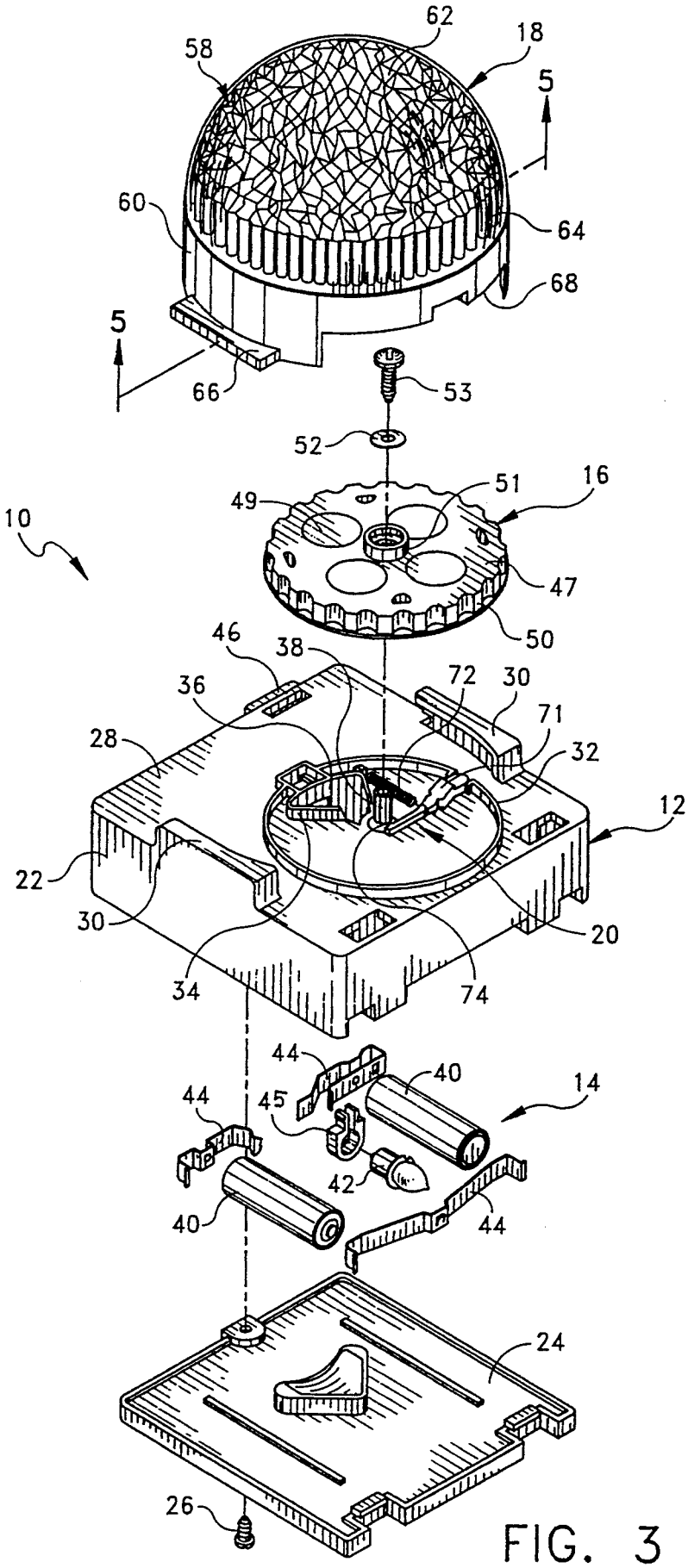
FIG. 3 is a front exploded perspective view thereof.
Figure 4:
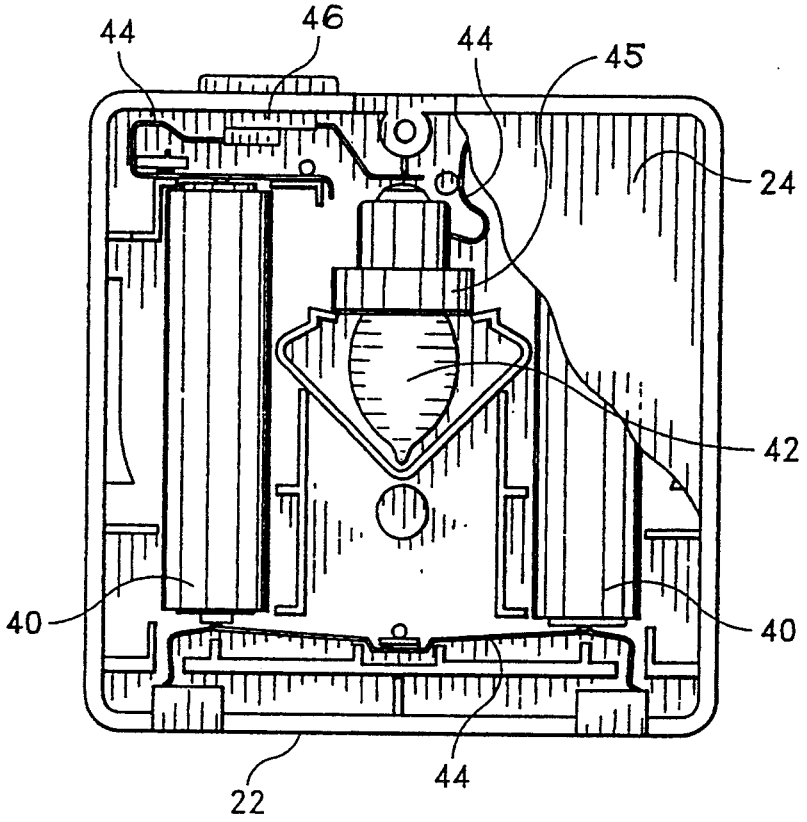
FIG. 4 is a sectional view taken along line 4—4 in FIG. 2.
Figure 5:
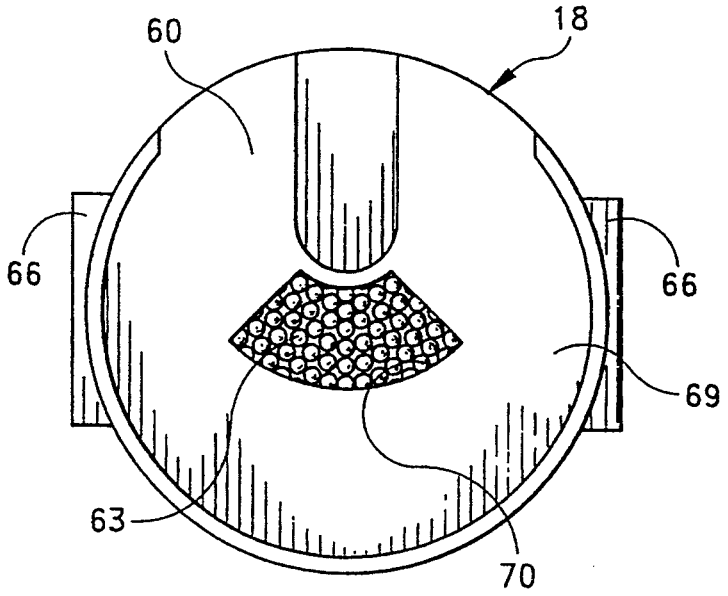
FIG. 5 is a bottom plan view of the diffuser dome portion of the random play indicator.

Referring now to the drawings, the random play indicator of the instant invention is illustrated in FIGS. 1 through 6 and generally indicated at 10 in FIGS. 1 through 3 and 6. The random play indicator 10 includes a base portion generally indicated at 12, a light source assembly generally indicated at 14 in the base portion 12, a randomizer wheel generally indicated at 16 on the base portion 12, and a diffuser dome generally indicated at 18. The randomizer wheel 16 is rotatably mounted on the base portion 12, and the light source assembly 14 is operative for illuminating different colored portions of the randomizer wheel 16 as they pass over a predetermined light station area on the base portion 12. The diffuser dome 18 is received on the base portion 12 over the randomizer wheel 16 for diffusing light passing through the randomizer wheel 16 so that when the randomizer wheel 16 comes to rest, the diffuser dome 18 glows with light of a particular color as determined by the randomizer wheel 16. The random play indicator 10 further comprises an indexing mechanism generally indicated at 20 on the base portion 12 for orienting the randomizer wheel 16 so that the diffuser dome 18 is only illuminated with light of a single color whenever the randomizer wheel 16 is at rest.

The base portion 12 comprises an upper housing section 22 which is integrally molded from a suitable plastic material and a bottom wall section 24 which cooperates with the upper housing section 22 to define a substantially closed interior cavity for containing the light source 14. The bottom wall section 24 is releasably secured in assembled relation with the upper housing section 22 with a screw 26, and the upper housing section 22 includes a top wall 28 having a pair of spaced retainer brackets 30 formed thereon. Also formed on the top wall 28 as part of the upper housing section 22 is a substantially circular ring 32, and a rounded, partially triangular light station boss 34 is provided in the interior of the circular ring 32. The light station ridge 34 defines an opening in the top wall 28 which forms a light station area 36 in the base portion 12. Also integrally formed in the base portion 12 is a center mounting boss 38 which is disposed at the center of the substantially circular ring 32. As will be seen, the ring 32 and the mounting boss 38 are oriented so that the ring 32 extends to a point which is closely adjacent the perimeter of the housing section 22, and the light station 36 is located at a substantially diametrically opposite position in the ring 32 relative to that portion of the ring 32 which passes the side perimeter of the housing section 22.

The light assembly 14 comprises a conventional battery operated light assembly, and it includes a pair of batteries 40 which are electrically connectible to a light bulb 42 through a plurality of contact elements 44. The light assembly 14 further comprises a light bulb holder 45 and a switch 46 which is slidably mounted on the side wall of the upper housing section 22. The main components of the light assembly 14 are mounted in the interior of the upper housing section 22, as illustrated most clearly in FIG. 4, and the light bulb 42 is mounted so that it shines through the opening defined by the ridge 34 at the light station 36. The contact elements 44 are mounted in the upper housing section 22 for electrically connecting the batteries 40 in series relation so that a completed circuit can be made between the batteries 40 and the light bulb 42 by sliding the switch 46 on the outer side wall of the upper housing section 22 in a conventional manner. In this regard, one of the contact elements 44 is positioned so that it permanently engages the cylindrical perimeter of the base portion of the light bulb 42, and the switch 46 is positioned so that it is engagable with the contact on the terminal end of the base portion of the light bulb 42 to electrically connect the batteries 40 to the light bulb 42 in a conventional manner.

Figure 6:
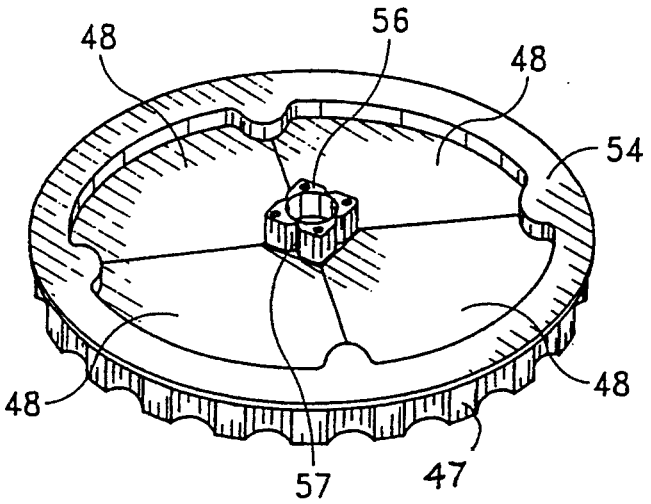
FIG. 6 is a bottom perspective view of the randomizer wheel.

The randomizer wheel 16 comprises a main disk portion 47 which is preferably integrally molded from a transparent plastic material in a substantially circular configuration and a plurality of translucent colored sectors or segments 48 which are assembled on the underside of the main portion 47. Each of the colored segments 48 is made of a thin translucent plastic material of a different color, and in the randomizer wheel 16 as herein embodied, each extends over a 90° segment of the randomizer wheel 16. A circular lens area 49 is formed in the main portion 47 above each of the colored segments 48 for causing light passing upwardly through the main portion 47 to diverge outwardly. Each of the lens areas 49 is preferably formed as a concave recess on the underside of the main portion 47. The main portion 47 further includes a knurled peripheral rim 50 and a tubular boss 51 extends upwardly from the center of the main portion 47 for receiving a washer 52 and a screw 53 for rotatably securing the randomizer wheel 16 to the mounting boss 38. Formed on the underside of the main portion 47 is a peripheral retaining rim 54 for retaining the colored segments 48. The retaining rim 54 is dimensioned to travel in closely upwardly spaced relation to the ring 32 as the randomizer wheel 16 is rotated so as to minimize the passage of light outwardly therebetween. Also extending downwardly from the main portion 47 is a centrally located, generally square boss 56 having notches 57 formed in the midpoints of the sides thereof as illustrated in FIG. 6.

Figure 7:
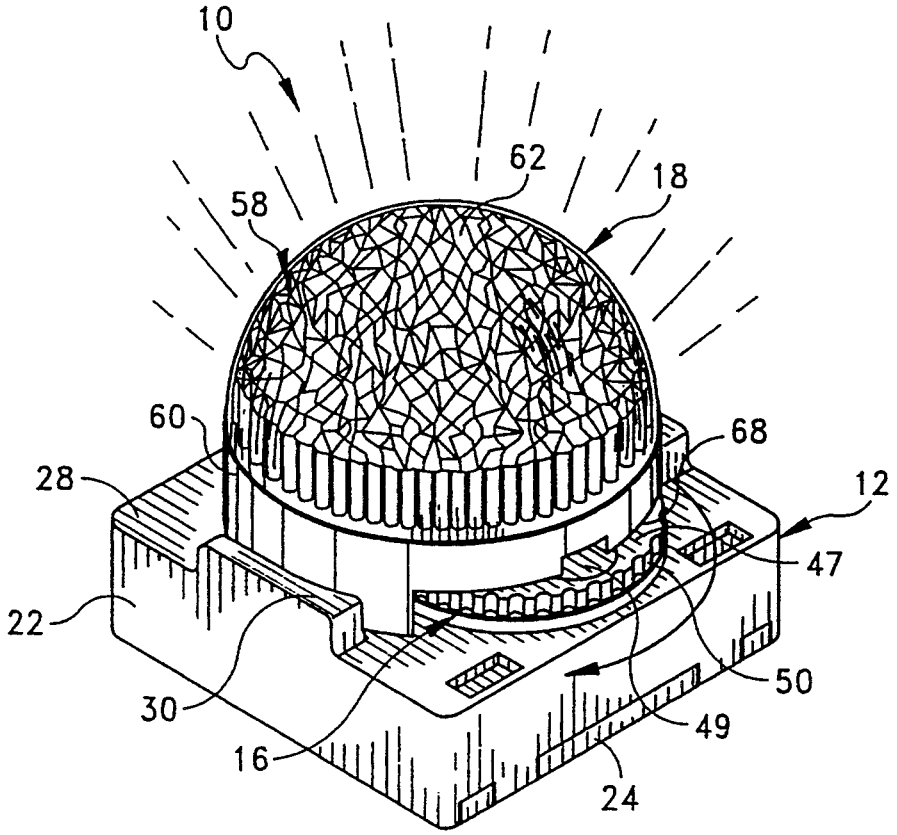
FIG. 7 is a front perspective view illustrating the operation of the random play indicator.
Figure 8:
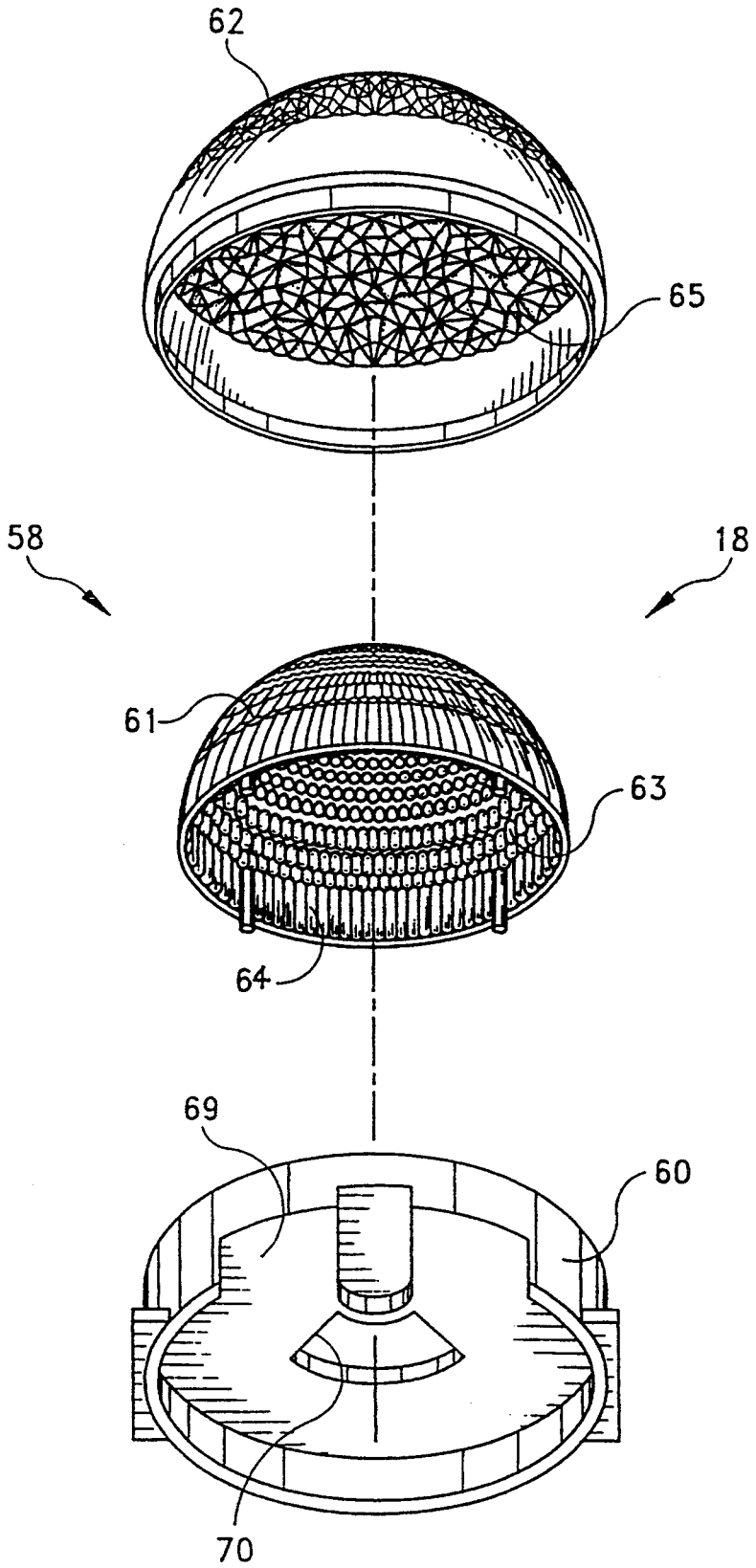
FIG. 8 is an exploded perspective View of the diffuser dome.

The diffuser dome 18 comprises a main dome portion 58 and a lower base portion 60. The main dome portion 58 includes concentric inner and outer dome elements 61 and 62, respectively. The inner dome element 61 has a plurality of rounded bumps or lenticular elements 63 formed in the upper portion of the underside thereof and a plurality of semicylindrical posts or rods 64 formed in the lower portion of the underside thereof, and the outer surface of the inner dome element 61 is substantially smooth. The outer dome element 62 has a crinkled inner surface 65, and the outer surface thereof is substantially smooth. Accordingly, the inner and outer dome elements 61 and 62, respectively, cooperate to both reflect and diffuse light within the main portion 58 so that light passing upwardly through one of the colored segments 48 on the randomizer wheel 16 causes the entire main portion 58 of the dome portion 18 to glow with light of the same color as the illuminated segment 48. In other words, the lenticular elements 63 and the rods 64 on the inner dome element 61 and the crinkled surface 65 on the outer dome element 62 have the effect of distributing light passing upwardly through the randomizer wheel 16 so that the light passes substantially uniformly outwardly through the entire outer surface of the main portion 58. Further the crinkled inner surface 65 tends to cause the outer dome element 62 to sparkle as it glows with light of the randomly selected color. The dome elements 61 and 62 are received and secured on the base portion 60, and the base portion 60 has a pair of mounting arms 66 formed thereon which are adapted to be received in the brackets 30 for mounting the diffuser dome 18 on the base portion 12 with the brackets 30. Formed along one side of the base portion 60 is an open area 68, and, as illustrated in FIGS. 1 and 7, when the diffuser dome 18 is received on the base portion 12, a portion of the randomizer wheel 16 extends outwardly through the open area 68 to enable a user to engage the knurled peripheral surface 50 of the randomizer wheel 16 in order to rotate the randomizer wheel 16 on the base portion 12. The base portion 60 also includes a bottom wall 69 having a window 70 therein, which is aligned with the light station 36.

The indexing mechanism 20 comprises an indexing arm 71 and a coil spring 72. The indexing arm 71 is pivotally mounted on the upper surface of the main housing section 22, and it has a ridge 74 on the terminal end thereof. The indexing arm 71 is biased by the spring 72 to a position wherein the ridge 74 engages the boss 56 on the underside of the randomizer wheel 16 to cause the randomizer wheel 16 to be oriented in a position wherein one of the sector elements 48 is aligned with the light station 36 whenever the randomizer wheel 16 comes to rest. Specifically, the indexing arm 71 operates so that the ridge 74 tends to pass into the adjacent notch 57 whenever the randomizer wheel 16 comes to rest for properly orienting the randomizer wheel 16 so that only a single one of the sector elements 48 is aligned with the light station 36.

For use and operation of the random play indicator 10 a game player applies a rotational force to the randomizer wheel 16 by engaging the knurled surface 50 so that the randomizer wheel 16 is rotated several revolutions on the base 12. When the randomizer wheel 16 comes to rest, one the sector elements 48 is automatically aligned with the light station 36 by the operation of the .indexing mechanism 20 so that light of a single color is passed upwardly through the randomizer wheel 16 and onto the inner surface of the diffuser dome 18. The light passing upwardly through the randomizer wheel 16 is reflected and diffused in the randomizer dome 18 so that the main portion 58 tends to glow and sparkle with light of a single color as determined by the aligned sector element 48. Hence, the entire main portion 58 of the diffuser dome 18 is illuminated with light of a randomly selected color for indicating a course of game play in accordance with predetermined game rules.

It is seen therefore that the instant invention provides an effective random play indicator. The device 10 includes a randomizer wheel 16 which is operative for emitting light of a randomly selected color, and the diffuser dome 18 is operative for diffusing the light from the randomizer wheel 16 so that the entire main dome portion 58 is illuminated with light of the randomly selected color. Further, the random play indicator 10 is easy to use by merely engaging the knurled rim 50 on the randomizer wheel 16 to rotate the randomizer wheel 16 on the base 12, and the indexing mechanism 20 is operative for positively aligning one of the colored segments 48 with the light station 36 wherever the randomizer wheel 16 comes to rest. Hence, it is seen that the random play indicator 10 represents a significant improvement in the toy art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A random play indicator comprising:

a. a base having a light station thereon;

b. a randomizer wheel including a plurality of different colored radially extending, translucent sectors, said randomizer wheel being rotatably mounted on said base so that sequential sectors thereon sequentially pass by said light station; and c. light source means on said base for selectively illuminating the sector located at the light station at any given time.

2. The random play indicator of claim 1 further comprising a translucent diffuser dome over said randomizer wheel for diffusing the light emitted from the sector illuminated at any given time.

3. In the random play indicator of claim 2, said diffuser dome having a multifaceted inner surface facing said randomizer wheel.

4. In the random play indicator of claim 2, said diffuser dome having an open area along one side thereof, a portion of said randomizer wheel extending outwardly through said open area at any given time to permit manual rotation of said randomizer wheel with a finger of a user.

5. In the random play indicator of claim 4, said light station being positioned so as to illuminate the sector on said randomizer which is substantially diametrically opposite to the portion of said randomizer wheel which extends outwardly through said open area.

6. In the random play indicator of claim 2, said diffuser dome comprising concentric inner and outer dome elements, one of said inner and outer dome elements having a crinkled inner surface.

7. In the random play indicator of claim 6, the other one of said inner and outer dome elements having a lenticular inner surface, including a plurality of rounded bumps thereon.

8. The random play indicator of claim 1 further comprising registration means for assuring that only a single sector is located at said light station at any given time when said randomizer wheel is in stationary relation with respect to said light station.

9. The randomizer play indicator of claim 8 further comprising a translucent diffuser dome over said randomizer wheel for diffusing the light emitted from the sector positioned at the light station at any given time.

* * * * *